US008597087B2

(12) United States Patent
Shermer et al.

(10) Patent No.: US 8,597,087 B2
(45) Date of Patent: Dec. 3, 2013

(54) UNIVERSAL ABRASIVE SHEET

(71) Applicant: Black & Decker Inc., Newark, DE (US)

(72) Inventors: Jason C. Shermer, Baltimore, MD (US); Matthew J. Holland, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 13/886,698

(22) Filed: May 3, 2013

(65) Prior Publication Data

US 2013/0244554 A1 Sep. 19, 2013

Related U.S. Application Data

(63) Continuation of application No. 11/099,254, filed on Apr. 5, 2005, now Pat. No. 8,444,457, which is a continuation of application No. 10/072,435, filed on Feb. 8, 2002, now abandoned.

(51) Int. Cl.
*B24D 11/00* (2006.01)

(52) U.S. Cl.
USPC ..... 451/533; 451/526; 451/527; 451/529; 451/539

(58) Field of Classification Search
USPC ..... 451/526, 527, 529, 533, 539
See application file for complete search history.

(56) References Cited

U.S. PATENT DOCUMENTS

| | | | |
|---|---|---|---|
| 1,635,350 | A | 7/1927 | Simons |
| 4,288,233 | A | 9/1981 | Wiand |
| 4,536,911 | A | 8/1985 | Demetriades |
| 4,893,438 | A | 1/1990 | Fry et al. |
| 5,035,684 | A | 7/1991 | Sorrells |
| 5,170,595 | A | 12/1992 | Wiand |
| 5,367,839 | A | 11/1994 | Pearce |
| D355,105 | S | 2/1995 | Nemazi |
| 5,681,362 | A | 10/1997 | Wiand |
| 5,685,042 | A | 11/1997 | Demetriades |
| D389,388 | S | 1/1998 | Longstaff et al. |
| 5,759,094 | A | 6/1998 | Bosten et al. |
| 5,807,161 | A | 9/1998 | Manor et al. |
| 5,807,169 | A | 9/1998 | Martin et al. |
| 5,839,949 | A | 11/1998 | Martin et al. |

(Continued)

FOREIGN PATENT DOCUMENTS

| | | |
|---|---|---|
| EP | 496514 | 7/1992 |
| EP | 1166963 | 1/2002 |
| WO | 0006341 | 2/2000 |

OTHER PUBLICATIONS

Black & Decker "Firestorm High Performance Cordless Tools," Form No. LCPC99, pp. 52-53.

*Primary Examiner* — Lee D Wilson
*Assistant Examiner* — Shantese McDonald
(74) *Attorney, Agent, or Firm* — Harness, Dickey & Pierce, P.L.C.

(57) ABSTRACT

A universal abrasive sheet is provided for a sanding or polishing machine and includes segments defined by weakened regions that allow portions of the universal abrasive sheet to be removed in order to adapt the abrasive sheet to alternative platent configurations. Each of the different configurations of the universal abrasive sheet can be provided with an individualized tip portion which can be separated from a body portion and either repositioned or replaced in order to change the working point of the tip portion when it becomes worn out.

5 Claims, 2 Drawing Sheets

(56) References Cited

U.S. PATENT DOCUMENTS

| | | | | |
|---|---|---|---|---|
| 5,879,227 | A | 3/1999 | Martin et al. | |
| 5,885,144 | A | 3/1999 | Martin et al. | |
| D409,890 | S | 5/1999 | Longstaff et al. | |
| 5,918,341 | A | 7/1999 | Hale | |
| 6,042,460 | A | 3/2000 | Bosten et al. | |
| 6,045,887 | A | 4/2000 | Martin et al. | |
| 6,099,397 | A | 8/2000 | Wurst | |
| 6,165,060 | A | 12/2000 | Martin et al. | |
| 6,186,878 | B1 * | 2/2001 | Takizawa et al. | 451/357 |
| 6,257,969 | B1 | 7/2001 | Bosten et al. | |
| 2001/0055944 | A1 * | 12/2001 | Moolenaar et al. | 451/357 |
| 2002/0016143 | A1 | 2/2002 | Bosten et al. | |

* cited by examiner

FIG 1
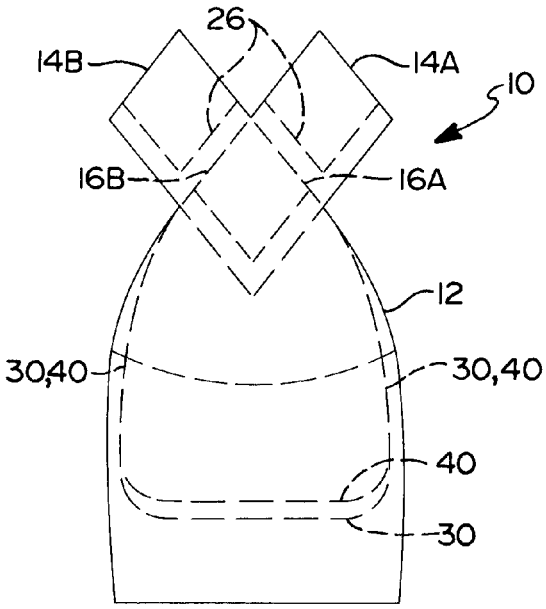
FIG 2
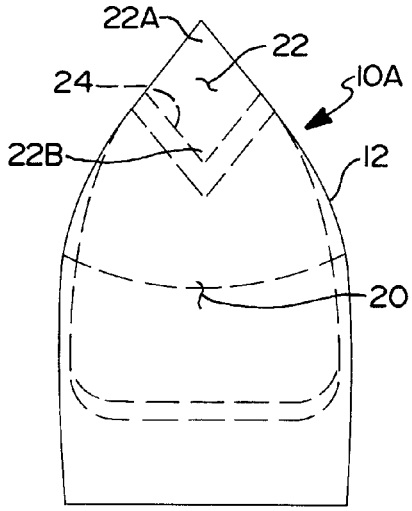
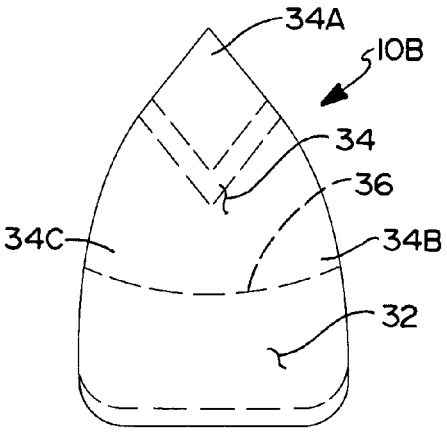
FIG 3
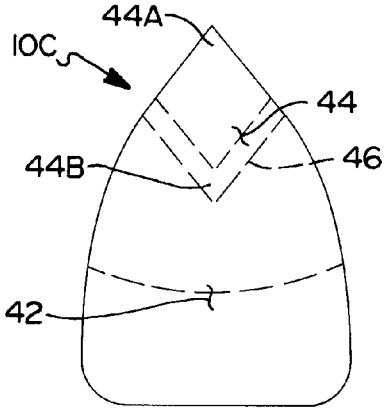
FIG 4

FIG 5
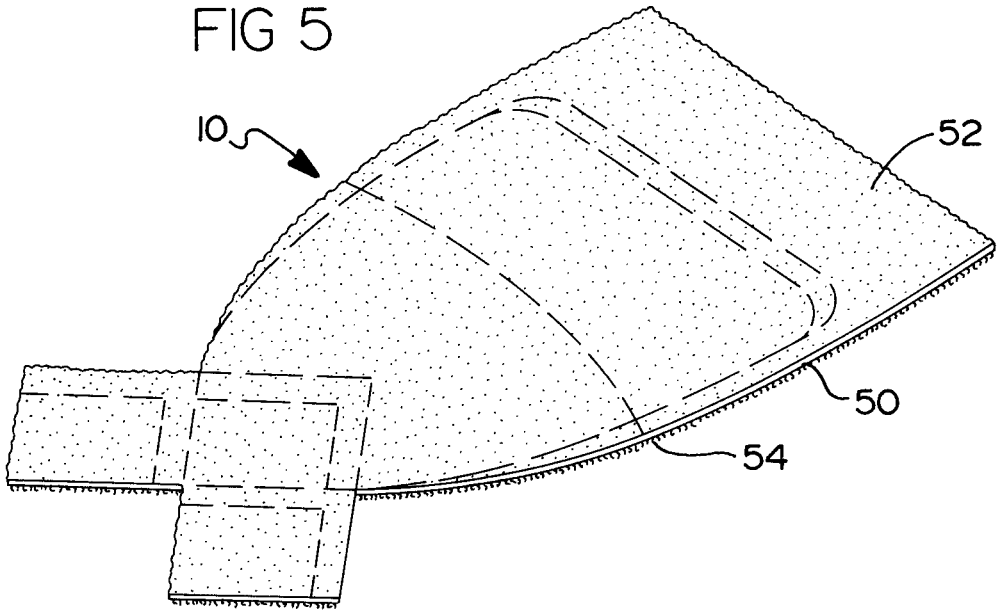
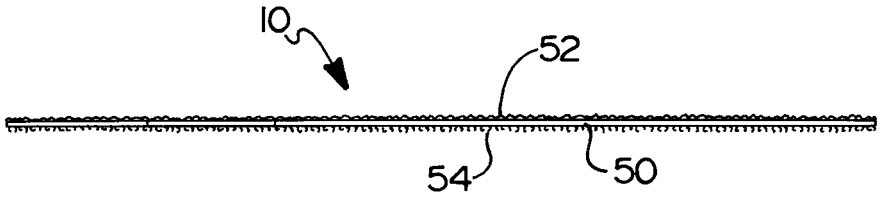
FIG 6

UNIVERSAL ABRASIVE SHEET

CROSS-REFERENCE TO RELATED APPLICATIONS

This application is a continuation of U.S. patent application Ser. No. 11/099,254, filed Apr. 5, 2005, which is a continuation of U.S. patent application Ser. No. 10/072,435, filed on Feb. 8, 2002 (now abandoned), the disclosures of which are incorporated herein by reference.

FIELD

The present invention relates to abrasive sheets, such as sand paper, glass paper, or any sheet material used for sanding or polishing, and more particularly, to a universal abrasive sheet that can be utilized with sanding or polishing machines having platents with different configurations.

BACKGROUND AND SUMMARY

Hand-held electric sanders are well known. Many such sanders are designed to carry rectangular sandpaper sheets. Although such sanders have been very popular, they have not always enabled a user to sand in tight corners, for example. Hence, sanders have been designed to accommodate triangular sheets of sandpaper or sheets of sandpaper having a shape similar to an iron base. Both of these shapes enable the use of a sander to reach into tight corners of a workpiece to achieve complete sanding of the workpiece. By providing a sandpaper sheet which is triangular, the sheet is effectively provided with three different tips. Hence, since it is usually the tip of a sandpaper sheet which wears out first, a triangular sandpaper sheet can be made to last up to three times as long as a sheet with only one tip simply by removing the sheet from the base of the sander, rotating the sheet through 120 degrees and replacing the sheet on the sander base. This can, of course, be done twice before the three tips of a sandpaper sheet are worn out.

In contrast to a triangular sandpaper sheet, the iron-shaped sandpaper sheet has only one tip for use in tight corners of a workpiece. The sheet does, however, have a great surface area than a triangular sheet which can be useful when a significant amount of plain sanding is also required. Further, the rounded edges of the iron-shaped sheet in the regions approaching the tip of the sheet enable the sander to work up close to a surface perpendicular to the working surface being sanded by the sander, by virtue of the sander "rolling" along the perpendicular surface. Thus, there are advantages to using an iron-shaped sandpaper sheet as opposed to triangular sandpaper sheets.

U.S. Pat. No. 6,045,887 assigned to the assignee of the present invention and herein incorporated by reference, discloses an iron-shaped sanding sheet which is provided with a tip portion that can be separated from the body portion, turned through an angle and repositioned adjacent the body portion to change the working point of the tip portion. By virtue of the removable tip portion, a complete sanding sheet having an iron shape, for example, can be manufactured from a single sheet, and yet the sheet can still have more than one working point to enable the sheet to last longer, during use.

Because there are multiple commercially available sanders having platents with different configurations, different sized replacement sandpaper sheets have been needed for each of the different commercially available sanders with differently configured platents.

In view of the foregoing, the present invention provides a universal abrasive sheet that can be utilized with different commercially available sanders having platents with different configurations. Specifically, the present invention provides a universal abrasive sheet including a sheet material being provided with a first configuration adapted to be used with a first platent configuration and having first segments defining areas of weakened material, wherein the sheet material is adapted to be separated along the first segments to change a configuration of the sheet material to correspond with a second differently configured platen. The sheet material also includes second segments defining regions of weakened material, wherein the sheet material is adapted to be separated along the second segments to change a configuration of the body portion to correspond with a third differently configured platent.

According to another aspect of the present invention, the sheet material includes a body portion and a tip portion, the body portion and tip portion having varying configurations defined by segments defining regions of weakened material wherein the sheet material is adapted to be separated along predetermined segments to separate a first tip portion, having a first tip configuration, from a first body portion having a first body configuration and the sheet material is adapted to be selectively separated along alternative segments to separate a second tip portion, having a second tip configuration different from the first tip configuration, from a second body portion having a second body configuration different from the first body configuration.

According to the principles of the present invention, the first and second tip configurations can have different sizes or different shapes, or both. The regions of weakened material are defined by a line of perforations or alternatively, a score line may be drawn on the sheet during manufacture to define the weakened regions. Other ways of producing a weakened region may, of course, alternatively be used.

According to another aspect of the present invention, the sheet material is further provided with at least one replacement tip portion extending from either of the body or tip portions and is defined by a segment defining regions of weakened material so that the replacement tip portion can be separated from the sheet material and used as a replacement tip portion when the original tip portion wears out.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DRAWINGS

The present invention will become more fully understood from the detailed description and the accompanying drawings, wherein:

FIG. 1 is plan view of a universal abrasive sheet according to the principles of the present invention;

FIG. 2 is a plan view of the abrasive sheet of FIG. 1 with the replacement tip portions removed from the sheet material, and the sheet material configured for use with a larger sized platent;

FIG. 3 is a plan view of the sheet of FIG. 1 with the sheet material being adapted to be used with an intermediate sized platent, according to the principles of the present invention;

FIG. 4 is a plan view of the sheet of FIG. 1 with the sheet adapted for use with a small sized platent, according to the principles of the present invention;

FIG. 5 is a perspective view of the universal abrasive sheet shown in FIG. 1; and FIG. 6 is a side view of the abrasive sheet of FIG. 1.

DETAILED DESCRIPTION

The following description of the preferred embodiment(s) is merely exemplary in nature and is in no way intended to limit the invention, its application, or uses.

With reference to FIGS. 1-6, the universal abrasive sheet 10, according to the principles of the present invention, will now be described. The universal abrasive sheet 10 of the present invention can be adapted for use with various commercial sanders having platents of different configurations. First, the universal abrasive sheet can be adapted to a configuration as shown in FIG. 2 in order to provide an abrasive sheet 10A that can be utilized with a larger sized platent configuration. The universal abrasive sheet 10 can also be adapted as an intermediate sized abrasive sheet 10B (as shown in FIG. 3) for use with an intermediate sized platent configuration. Finally, the universal abrasive sheet 10 can be adapted for use as a smaller sized abrasive sheet 10C (shown in FIG. 4) for use with smaller sized platent configurations.

With reference to FIG. 1, the universal abrasive sheet 10 includes an iron-shaped portion 12 and is provided with a pair of diamond or square shaped replacement tip portions 14A, 14B extending therefrom. The replacement tip portions 14A, 14B are attached to the iron-shaped portion 12 along segments 16A, 16B defined by regions of weakened material.

The iron-shaped portion 12 defines the abrasive sheet 10A, as shown in FIG. 2, which is adapted for use with a larger sized platent configuration. The large size abrasive sheet 10A includes a body portion 20 and a tip portion 22 separated by segments 24 defining regions of weakened material along which the tip portion 22 is separated from the body portion 20. The tip portion 22 is generally square or diamond shaped, although other shapes could be utilized. The tip portion 22 is capable of being removed and turned 180 degrees and reapplied to the platent so that both working points 22A, 22B of tip portion 22 can be utilized until worn out. When both working end portions 22A, 22B of tip portion 22 are worn out, replacement tip portions 14A, 14B can be utilized as replacements. Replacement tip portions 14A, 14B are each provided with segments 26 defining regions of weakened material that allow replacement tip portions of the same size as tip portion 22 to be separated from the replacement tip portions 14A, 14B.

As shown in FIG. 1, the universal abrasive sheet 10 is provided with segments 30 defining regions of weakened material that allow separation of the intermediate sized abrasive sheet 10B as shown in FIG. 3 for use with an intermediate sized platent configuration. The intermediate sized abrasive sheet 10B includes a body portion 32 and a tip portion 34 separated by a segment 36 defining regions of weakened material. The tip portion 34 can be separated from the body portion 32 along segment 36, turned through an angle of 120 degrees and re-positioned adjacent the body portion 32 in order to change the working point 34A-34C when one of the working points becomes worn out. The triangular configuration of the tip portion 34 allows for three working points 34A-34C to be utilized.

Again with reference to FIG. 1, the universal abrasive sheet 10 includes segments 40 defining regions of weakened material that allow the smallest abrasive sheet 10C to be separated from the universal abrasive sheet 10. The smallest abrasive sheet 10C includes a body portion 42 and a tip portion 44 that are separated by segments 46 defining regions of weakened material. The tip portion 44 can be separated from the body portion 42 so that when the working point 44A of the tip portion 44 becomes worn out, the tip portion 44 can be removed and turned 180 degrees and re-applied to the platent so that the working point 44B can then be utilized until it also becomes worn out. When both working points 44A, 44B of tip portion 44 are worn out, replacement tip portions 14A, 14B which are removed from the universal abrasive sheet 10 (shown in FIG. 1) can be utilized as replacement tip portions.

As best shown in FIGS. 5 and 6, the universal abrasive sheet 10 includes a support medium 50, such as a mesh, web, or sheet supporting on one side a layer 52 of abrasive material and a resin; and on the other side, a layer of loops or eyes 54 of a hook and loop-type fastening system. The loops or eyes 54 are designed to cooperate with hooks or loops on a base platent (not shown) of a sanding machine or polishing machine in order to hold the abrasive sheet 10 in position on the base of the sanding or polishing machine. By using a hook-and-loop fastening system, the tip portions can easily be removed for replacement or rotated and reinstated in position on the base of the sanding or polishing machine. The specific embodiment shown provides tip portions 22, 44 having two working points 22A, 22B; 44A, 44B and a tip portion 44 having three working points 34A-34C. Although not specifically disclosed in the drawings, tip portions having four, five, six, seven, etc. working points, could, in theory, alternatively be used.

The regions of weakened material as described above may comprise a line of perforations or alternatively, a score line may be drawn on the sheet during manufacture to define the weakened regions. Other ways of producing a weakened region may, of course, alternatively be used. As an alternative, the weakened regions can be eliminated altogether with the segments being simply marked to define the lines along which a user can cut out the different configurations using a blade or scissors.

While the shape of the abrasive sheets 10A-10C have all been disclosed as being generally iron-shaped, it should be appreciated that other shaped universal abrasive sheets may be utilized in accordance with the principles of the present invention in order to allow a plurality of abrasive sheet configurations to be achieved for accommodating the different sizes and shapes of platents of various sanding and polishing machines.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A universal abrasive sheet for use with alternative sanding or polishing machines having platens with different configurations, comprising:

a sheet material having an abrasive material disposed on a face and having a body portion provided with a first configuration adapted to be used with a first platen configuration and having first marking segments, wherein said sheet material is adapted to be separated along said first marking segments to provide said body portion of said sheet material with a second configuration that is different from said first configuration that corresponds with a second platen configuration having different external dimensions, said first configuration having a first iron shaped perimeter with two arcuate first side edges converging at a tip portion and extending from the tip portion to opposite sides of a first base edge portion having a first width, said first configuration having a first length dimension from said tip portion to said first base edge, said second configuration having a second iron shaped perimeter with two arcuate second side edges converging at the tip portion and extending from the tip portion to opposite sides of a second base edge portion having a second width narrower than said first width, wherein at least a portion of said second side edges are narrower than at least a portion of said first side edges, said second configuration having a second length dimension from said tip portion to said second base edge that is shorter than said first length dimension.

2. The abrasive sheet according to claim 1, wherein said sheet material further comprises second segments defining regions of weakened material, wherein said sheet material is adapted to be separated along said second segments to change a configuration of said body portion to correspond with a third differently configured platen.

3. The abrasive sheet according to claim 1, wherein said tip portion of said body portion is adapted to be separated along second marking segments to separate the tip portion from said body portion.

4. The abrasive sheet of claim 1, further comprising attachment means for attaching said abrasive sheet to a platen.

5. The abrasive sheet of claim 4, wherein said attachment means includes hooks or eyes of a hook-and-loop fastening system.

* * * * *